US005380190A

United States Patent [19]

Kumagai

[11] Patent Number: 5,380,190

[45] Date of Patent: Jan. 10, 1995

[54] PULSE COMBUSTOR

[75] Inventor: Naoki Kumagai, Sapporo, Japan

[73] Assignee: Paloma Kogyo Kabushiki Kaisha, Nagoya, Japan

[21] Appl. No.: 110,059

[22] Filed: Aug. 20, 1993

[30] Foreign Application Priority Data

Sep. 3, 1992 [JP] Japan ..... 4-260680

[51] Int. Cl.[6] ..... F23C 11/04

[52] U.S. Cl. ..... 431/1; 431/114

[58] Field of Search ..... 431/1, 114, 160, 347, 431/19, 25, 27, 31

[56] References Cited

U.S. PATENT DOCUMENTS 5,044,929 9/1991 Tabuchi et al. ..... 431/1

FOREIGN PATENT DOCUMENTS 4-73510 9/1992 Japan .

*Primary Examiner*—James C. Yeung

*Attorney, Agent, or Firm*—W. Hugo Liepmann

[57] ABSTRACT

The present invention provides a relatively compact-sized pulse combustor which efficiently reduces an undesirable explosion and combustion noise without any bulky muffler. In the pulse combustor of the invention, a compensating sound is generated in an exhaust conduit synchronously with pulsative explosion and combustion. The compensating sound has a sound pressure identical with that of a noise in the exhaust conduit but a phase opposite to that of the noise, thus effectively compensating the noise in the exhaust conduit and efficiently reducing the noise from an exhaust outlet.

15 Claims, 4 Drawing Sheets

PULSE COMBUSTOR

BACKGROUND OF THE INVENTION

1. Field of the Invention

The present invention relates to a pulse combustor for repeating pulsative explosion and combustion, and more specifically to a silencer device used in such a pulse combustor.

2. Description of the Related Art

Conventional pulse combustors for continuing combustion of an air/fuel mixture by pulsative explosion thereof generally include a silencer device such as a muffler for reducing a relatively large noise due to the pulsative explosion and combustion. FIG. 4 schematically illustrates such a conventional pulse combustor.

The pulse combustor of FIG. 4 primarily consists of a combustion-exhaust system, an air supply system, and a fuel gas supply system. The combustion-exhaust system includes a combustion chamber 1 for pulse combustion, a tail pipe 2 constituting an exhaust conduit of hot combustion byproducts discharged from the combustion chamber 1, a decoupler 3 connected to the tail pipe 2, and an exhaust muffler 4 connected to the decoupler 3. The air supply system for supplying air to the combustion chamber 1 includes a fan 5 for feeding the air for combustion, and an air chamber 6 coupled with and connected to the combustion chamber 1 for receiving the air fed by the fan 5. The fuel gas supply system includes a solenoid valve 8 for opening and closing to allow and stop a flow of a fuel gas supplied from a gas conduit 7, and a gas chamber 9 disposed in the air chamber 6 for receiving the fuel gas passing through the gas conduit 7.

The fuel gas supplied to the gas chamber 9 and the air fed to the air chamber 6 are flown into and sufficiently mixed with each other in a mixing chamber 10 arranged in the intake side of the combustion chamber 1. A mixture of the air and fuel gas is then supplied through a flame trap 11 to the combustion chamber 1, and ignited and explosively combusted in the combustion chamber 1. The negative pressure generated immediately after the explosion allows further admission of the fuel gas and the air into the mixing chamber 10 for subsequent combustion. Heat generated in such a cyclic explosion and combustion is applied to an object through the wail of the combustion chamber 1 and of the tail pipe 2.

The pulse combustor is further provided with an air flapper valve 12 and a gas flapper valve 13 respectively mounted at the inlets of the air and the fuel gas into the mixing chamber 10 to prevent back flow of combustion exhaust into the air supply system or the fuel gas supply system due to explosive combustion.

In the pulse combustor thus constructed, there is an undesirably large noise due to opening and closing of the air flapper valve 12 and the gas flapper valve 13, along with a combustion noise due to high combustion pressure. The conventional pulse combustor thus includes a silencer or an exhaust muffler 4 disposed in an exhaust conduit for noise reduction. The pulse combustor may also include an intake muffler (not shown) to prevent a noise from being generated at an intake of the fan 5.

It is known that mufflers generally used are divided into an expansion type and an resonance type, and in either type, a larger-sized muffler is required for effectively reducing a noise of a lower frequency. The pulse combustor thereby requires a relatively large muffler for effective noise reduction of pulse combustion at a low frequency (100 Hz in general). Such a large muffler prevents compact design of the pulse combustor, and moreover functions as a resistance to increase a pressure loss, which leads to a higher-power fan and enhanced fuel gas pressure.

SUMMARY OF THE INVENTION

One object of the invention is to efficiently reduce an undesirable noise in a pulse combustor.

Another object of the invention is to provide a relatively compact-sized pulse combustor having a reduced noise.

The above and other related objects are realized by an improved pulse combustor according to the invention, which includes a mixing chamber for receiving and mixing a fuel gas and air and supplying an air/fuel mixture, a combustion chamber connected to the mixing chamber for pulsative combustion of the air/fuel mixture supplied from the mixing chamber, a tail pipe constituted as a conduit of hot combustion byproducts, a gas supply system for supplying the fuel gas to the mixing chamber, an air supply system for supplying the air to the mixing chamber, and an exhaust conduit for discharging the hot combustion byproducts. The improvement of the pulse combustor is characterized by a synchronous signal generator for generating a synchronous signal synchronized with a cycle of the pulsative combustion, a data memory unit for storing silencing-acoustic waveform data, a silencing acoustic signal generator for outputting a silencing acoustic signal corresponding to the silencing-acoustic waveform data stored in the data memory unit, synchronously with the synchronous signal output from the synchronous signal generator, and a sound generator for converting the silencing acoustic signal to a compensating sound and outputting the compensating sound to the exhaust conduit of the hot combustion byproducts and/or the air supply system.

In the pulse combustor of the invention thus constructed, the synchronous signal generator outputs a synchronous signal synchronized with a cycle of pulsative explosion and combustion in the combustion chamber. The silencing acoustic signal generator then outputs to the sound generator a silencing acoustic signal corresponding to silencing-acoustic waveform data stored in the data memory unit, synchronously with the synchronous signal output from the synchronous signal generator. The sound generator subsequently converts the silencing acoustic signal to a compensating sound and outputs the compensating sound to the exhaust conduit of the hot combustion byproducts and/or the air supply system. The compensating sound to be composed with a noise due to pulse combustion has an antiphase shifted by a pi radian to be opposite to a noise phase, thus effectively compensating and reducing the noise.

Alternatively, the improvement is characterized by a synchronous signal generator for generating a synchronous signal synchronized with a cycle of the pulsative combustion, a noise characteristics detection unit for detecting characteristics of a noise due to the pulsative combustion, a data memory unit for storing a plurality of silencing-acoustic waveform data corresponding to a plurality of noise characteristics, a silencing acoustic signal generator for selecting suitable silencing acoustic waveform data corresponding to the noise characteristics detected by the noise characteristics detection unit out of the plurality of silencing-acoustic waveform data, and outputting a silencing acoustic signal corresponding to the selected silencing-acoustic waveform data, synchronously with the synchronous signal output from the synchronous signal generator, and a sound generator for converting the silencing acoustic signal to a compensating sound and outputting the compensating sound to the exhaust conduit of the hot combustion byproducts and/or the air supply system.

In the alternative structure of the pulse combustor, the data memory unit stores a plurality of silencing-acoustic waveform data corresponding to a plurality of noise characteristics. The silencing acoustic signal generator selects suitable silencing acoustic waveform data corresponding to the noise characteristics detected by the noise characteristics detection unit out of the plurality of silencing-acoustic waveform data, and outputs a silencing acoustic signal corresponding to the selected silencing-acoustic waveform data. This structure generates a compensating signal most suitable for characteristics of each noise, thus further improving noise reduction effects. The noise characteristics may be sound waveform data or corresponding physical properties such as a pulse frequency or temperature.

The pulse combustor of the invention may further include a regulator unit for regulating a sound pressure and/or a phase of the compensating sound generated by the sound generator, a sound pressure detecting unit for detecting a sound pressure of a composite sound of the noise and the compensating sound generated by the sound generator, and a feedback control unit for monitoring the sound pressure detected by the sound pressure detecting unit and actuating the regulator unit to make the sound pressure minimum.

In this structure of the pulse combustor, the sound pressure detecting unit detects a sound pressure of a composite sound of the noise and the compensating sound generated by the sound generator. The feedback control unit monitors the sound pressure and actuates the regulator unit to regulate a sound pressure and/or a phase of the compensating sound so as to make the sound pressure minimum. This feedback control system further improves the sound reduction effects.

These and other objects, features, aspects, and advantages of the present invention will become more apparent from the following detailed description of the preferred embodiment with the accompanying drawings.

DESCRIPTION OF THE PREFERRED EMBODIMENT

The pulse combustor of the invention is described more in detail according to preferred embodiments thereof.

Figure 1:
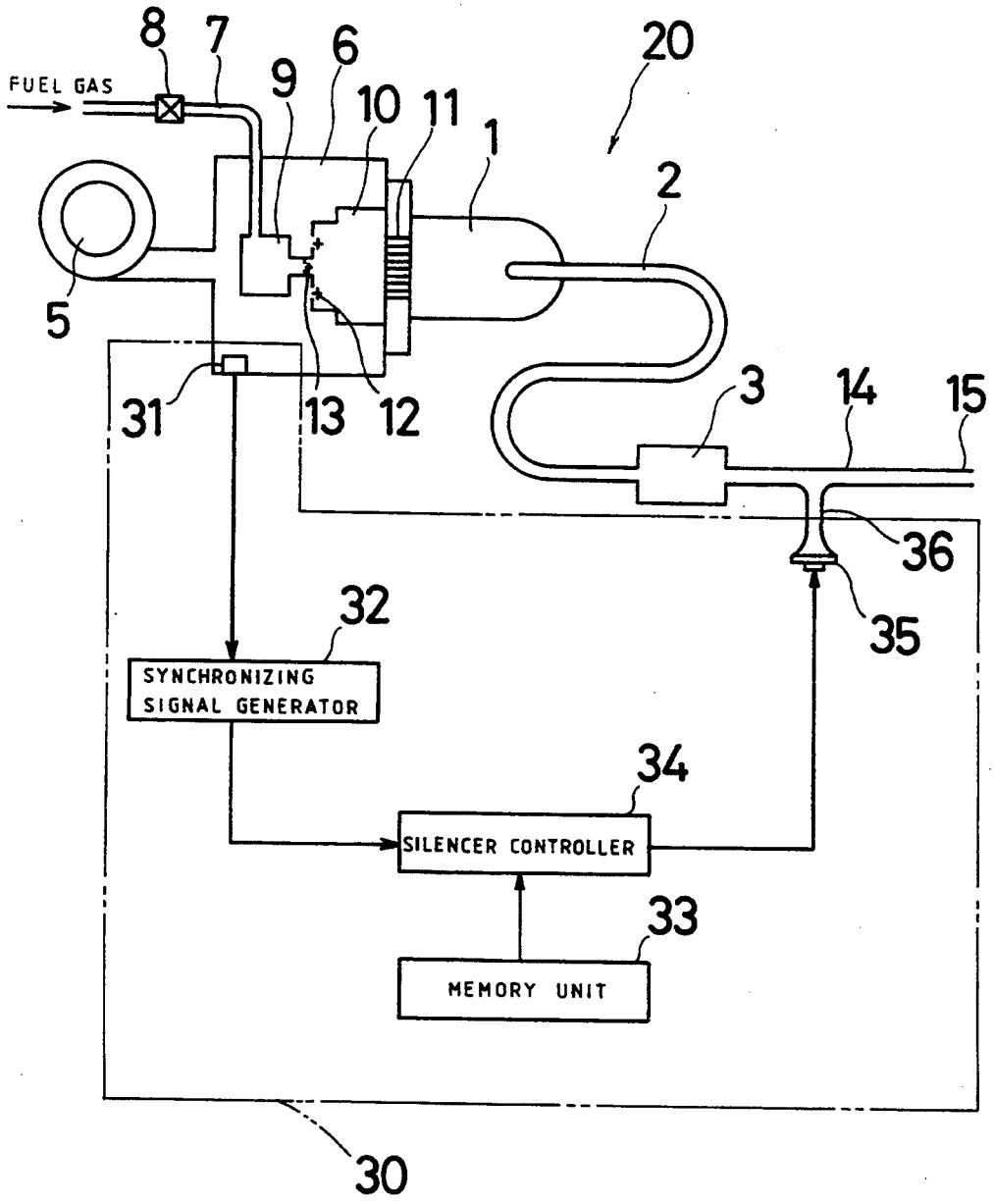
FIG. 1 schematically shows a pulse combustor apparatus of a first embodiment in accordance with the present invention.

FIG. 1 schematically shows a pulse combustor apparatus of a first embodiment in accordance with the invention. In the description herein, a process of noise reduction at an exhaust side is exemplified.

Figure 4:
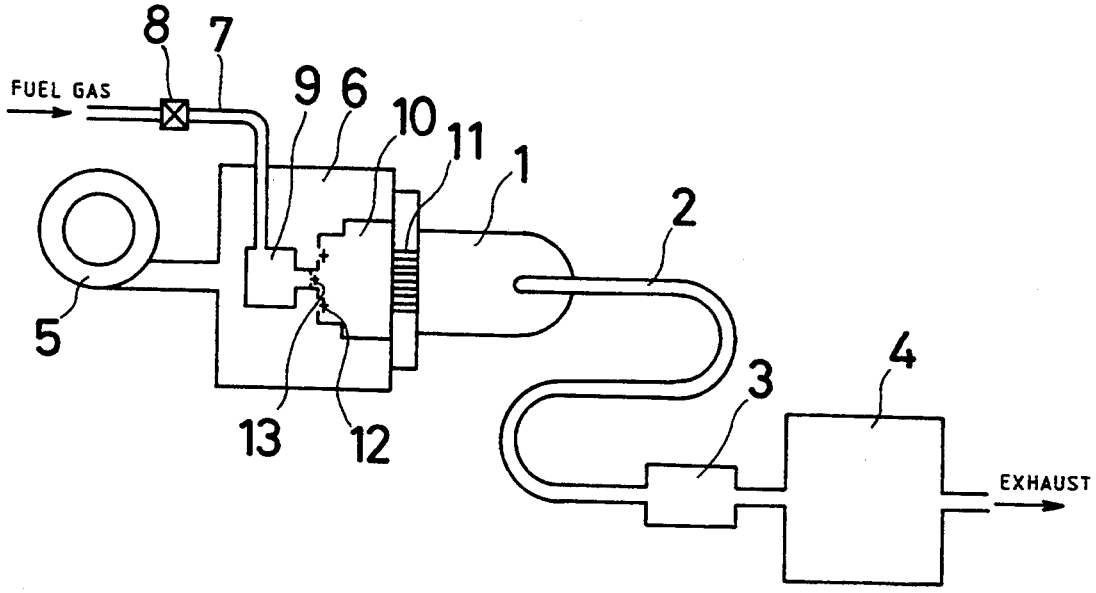
FIG. 4 PRIOR ART
FIG. 4 schematically illustrates a conventional pulse combustor.

A pulse combustor apparatus of the first embodiment includes a pulse combustor unit 20 and a silencer unit 30. The pulse combustor unit 20 has the same structure as that of the conventional pulse combustor shown in FIG. 4, except that the pulse combustor unit 20 does not include an exhaust muffler 4. The same numerals in FIG. 1 denote the hike elements to those of FIG. 4, which are not described here.

The silencer unit 30 includes a pressure sensor 31 disposed in the air chamber 6 for detecting a pressure variation due to pulsative combustion and outputting a pressure signal representing the pressure variation in the air chamber 6, a synchronizing signal generator 32 for receiving the pressure signal output from the pressure sensor 31 and outputting a synchronous signal synchronized with a cycle of the pulse combustion, and a memory unit 33 for storing silencing-acoustic waveform data having a sound pressure identical with that of a noise caused by pulsative combustion but a phase opposite to that of the noise.

The silencer unit 30 also includes a silencer controller 34 for outputting a silencing acoustic signal corresponding to the silencing-acoustic waveform data stored in the memory unit 33, synchronously with the synchronous signal from the synchronizing signal generator 32, a speaker 35 for converting the silencing acoustic signal output from the silencer controller 34 to a compensating sound, and a sound wave transmission conduit 36 for introducing the compensating sound generated by the speaker 35 to an exhaust conduit 14.

In the pulse combustion process, pulsative explosion and combustion in the combustion chamber 1 leads to a pressure variation in the air chamber 6. The synchronizing signal generator 32 receives a pressure signal from the pressure sensor 31 representing the pressure variation in the air chamber 6 and outputs a synchronous signal corresponding to a frequency of pulse combustion.

A compensating sound for compensating and reducing a noise due to pulse combustion, such as a combustion noise or vibration in opening and closing the flapper valves 12 and 13, should have a sound pressure identical with a noise pressure but an antiphase of the noise. The memory unit 33 thus stores data having an antiphase of a sound waveform of the noise in the exhaust conduit 14, which is previously measured and detected. The silencer controller 34 outputs a silencing acoustic signal synchronously with pulse combustion, and the speaker 35 generates a compensating sound corresponding to the silencing acoustic signal. Composition of the noise transmitted through the exhaust conduit 14 with the compensating sound sufficiently reduces a noise output from an exhaust outlet 15. Although there is a certain time delay between detection of the pressure variation by the pressure sensor 31 and actual transmission of the noise to the exhaust conduit 14, fine regulation of the phase data stored in the memory unit 33 or control of the output timing of the silencing acoustic signal from the silencer controller 34 can make the noise and the compensating sound have completely opposite phases.

The structure of the first embodiment does not require a space-consuming large muffler and thereby realizes compact design of the pulse combustor. Removal of the muffler effectively reduces adverse effects of a pressure loss and attains desirable pulse combustion without significantly high air or fuel gas supply pressure.

The pulse combustor of the first embodiment includes the sound wave transmission conduit 36 between the speaker 35 and the exhaust conduit 14 to protect the speaker 35 from excessive heat or humidity. The sound wave transmission conduit 36 may, however, be omitted to allow the speaker 35 to be coupled with the exhaust conduit 14 directly when little effects of heat of humidity are expected. Although the pressure sensor 31 is disposed in the air chamber 6 to generate a pressure signal synchronous with pulse combustion in the above embodiment, the pressure sensor 31 may be arranged in the combustion chamber 1 or the decoupler 3 wherein a pressure variation due to pulsative combustion is also observed. The pressure sensor 31 may be replaced by a vibration sensor for detecting a vibration of pulse combustion, a temperature sensor for detection a variation in the combustion temperature, or a photo-sensor for detecting a variation in the luminous intensity in the combustion chamber 1.

The pulse combustor may further be provided with a control circuit which allows output of the compensating sound only when a combustion sensor such as a flame rod (not shown) detects actual combustion. This prevents the compensating sound from being mistakenly generated under non-combustion conditions.

Figure 2:
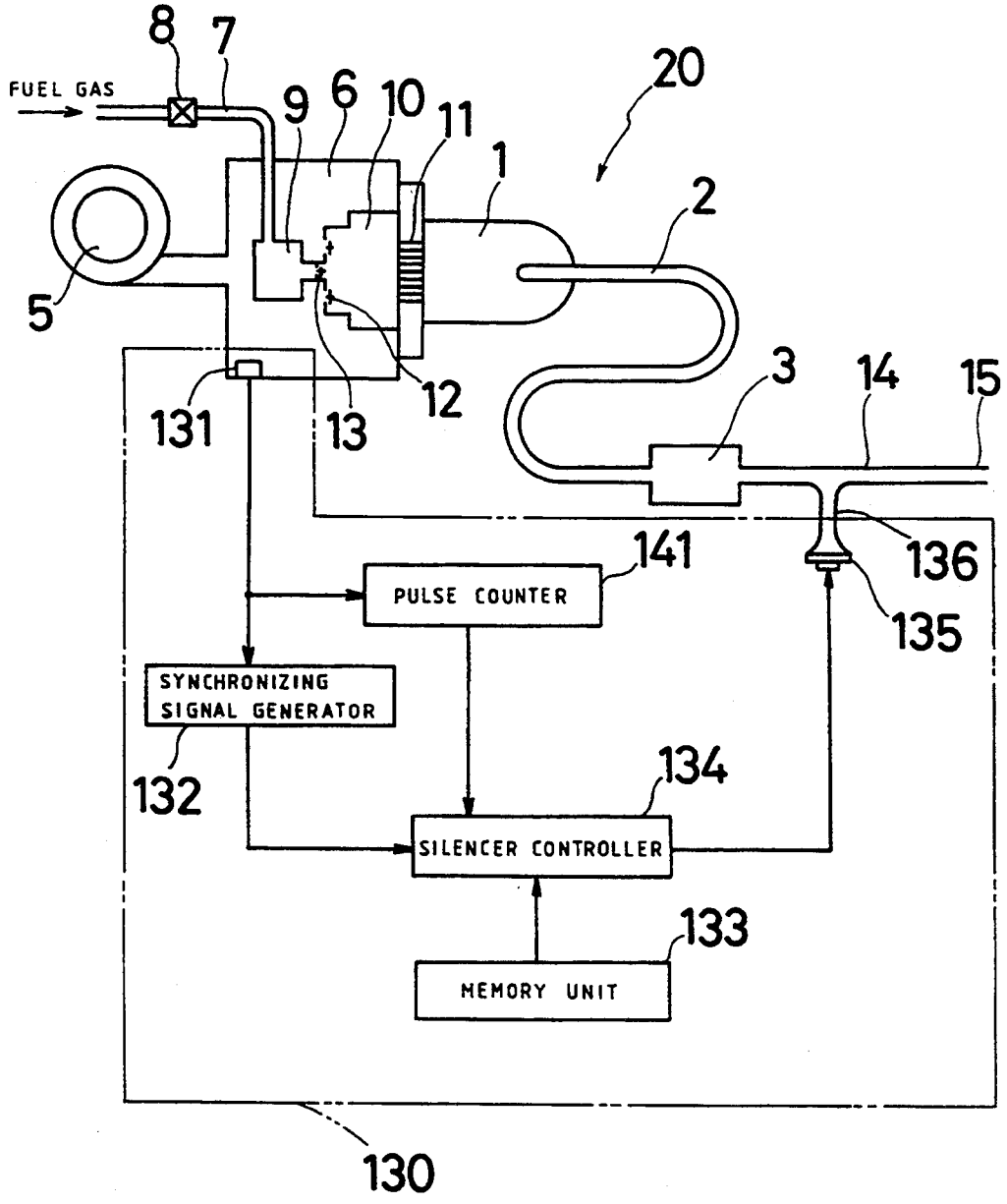
FIG. 2 schematically shows another pulse combustor apparatus of a second embodiment in accordance with the invention.

FIG. 2 schematically shows another pulse combustor apparatus of a second embodiment in accordance with the invention. The same numerals in FIG. 2 denote the like elements to those of FIG. 1, which are not described here.

Although the silencer unit 30 of the first embodiment generates a constant compensating sound against a stable combustion noise for noise reduction, a silencer unit 130 of the second embodiment further responds to a variation in the noise characteristics.

The noise characteristics are generally correlated to the physical properties of pulse combustion, such as a pulse combustion frequency or a combustion temperature. The silencer unit 130 thus includes a pulse counter 141 for determining a pulse frequency based on an output from a pressure sensor 131, and a memory unit 133 for storing a plurality of silencing-acoustic waveform data corresponding to a plurality of pulse combustion frequencies. The plurality of silencing-acoustic waveform data are determined against noise waveforms measured at the plurality of pulse combustion frequencies. A silencer controller 134 receives a synchronous signal output from a synchronizing signal generator 132 as well as the pulse frequency determined by the pulse counter 141, selects suitable silencing-acoustic waveform data out of the plurality of silencing-acoustic waveform data based on the pulse frequency, and outputs a silencing acoustic signal corresponding to the selected silencing-acoustic waveform data to a speaker 135 synchronously with the synchronous signal. The speaker 135 then converts the silencing acoustic signal to a compensating sound and outputs the compensating sound through a sound pressure transmission conduit 136. The compensating sound responding to the noise characteristics thus compensates the noise in an exhaust conduit 14 to effectively reduce a noise output from an exhaust outlet 15.

As described above, the structure of the second embodiment generates an appropriate compensating sound based on a variation in the noise characteristics, thus further improving the sound reduction effects.

The compensating sound may respond to an exhaust temperature detected by a temperature sensor (not shown) since the noise characteristics are correlated with the temperature.

Figure 3:
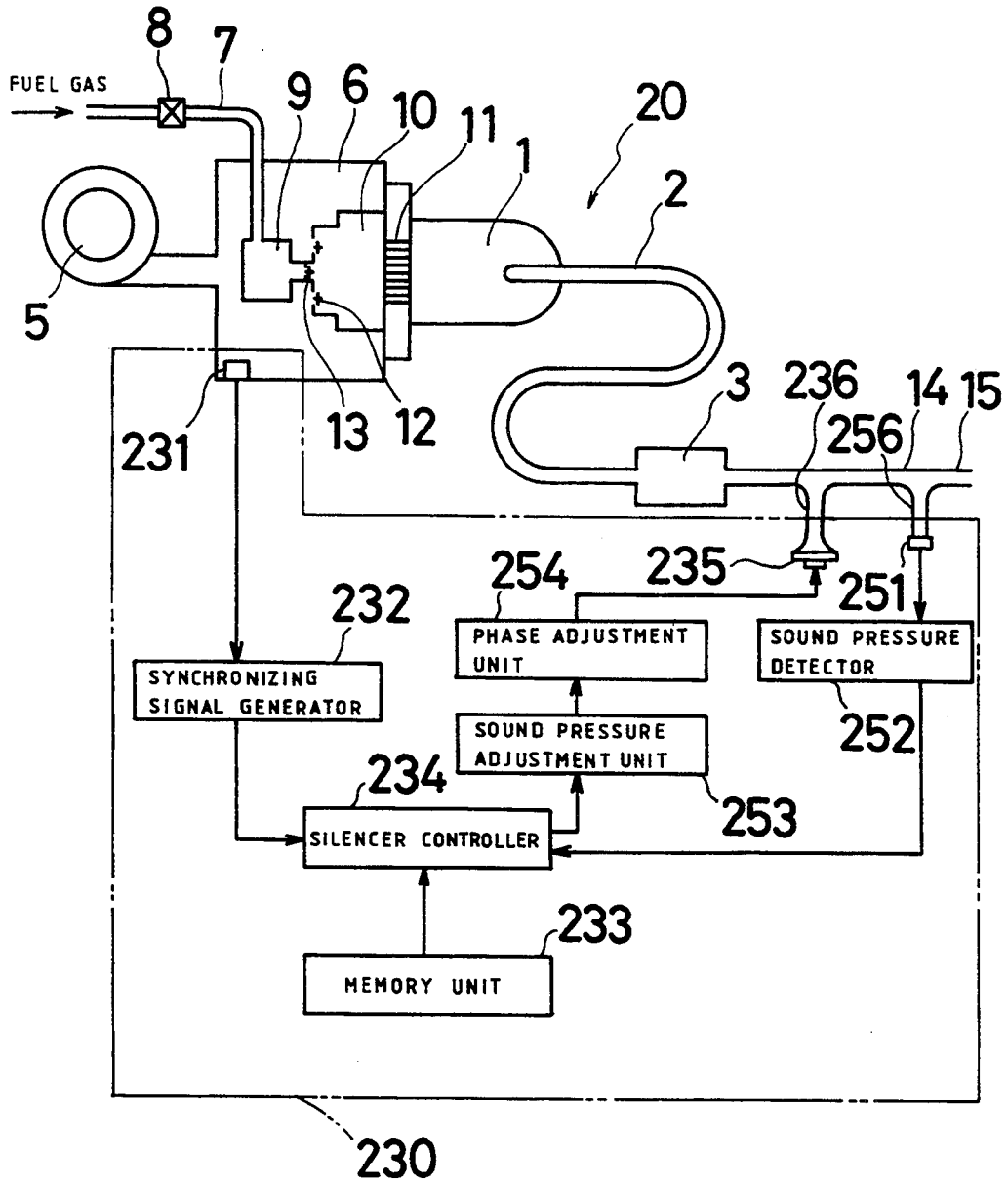
FIG. 3 schematically shows still another pulse combustor apparatus of a third embodiment in accordance with the invention.

FIG. 3 schematically shows still another pulse combustor apparatus of a third embodiment in accordance with the invention. The same numerals in FIG. 3 denote the like elements to those of FIG. 1, which are not described here.

A silencer unit 230 of the third embodiment includes a pressure sensor 231, a synchronizing signal generator 232, a memory unit 233, a speaker 235, a sound wave transmission conduit 236 as well as a microphone 251 for detecting a composite sound (composite sound of a noise and a compensating sound) in the exhaust conduit 14 and outputting a sound signal, a second sound wave transmission conduit 256 for protecting the microphone 251, and a sound pressure detector 252 for outputting a sound pressure level based on the sound signal output from the microphone 251. The silencer unit 230 further includes a sound pressure adjustment unit 253 for adjusting a sound pressure of a silencing acoustic signal, a phase adjustment unit 254 for adjusting a phase of the silencing acoustic signal, and a silencer controller 234 for outputting a silencing acoustic signal corresponding to silencing-acoustic waveform data stored in the memory unit 233 and controlling the sound pressure adjustment unit 253 and the phase adjustment unit 254 based on the sound pressure level detected by the sound pressure detector 252.

In the silencer unit 230 of the third embodiment, the silencer controller 234 reads silencing-acoustic waveform data stored in the memory unit 233 synchronously with a cycle of pulse combustion, and the speaker 235 outputs a compensating sound based on the waveform data. The silencer controller 234 monitors the sound pressure of a composite sound detected by the microphone 251, and controls the sound pressure adjustment unit 253 and the phase adjustment unit 254 to adjust the sound pressure and the phase of the compensating sound so as to make the sound pressure of the composite sound minimum. Such feedback control of the third embodiment makes the sound pressure of a final composite sound minimum, thus further improving the noise reduction effects.

The structure of the second embodiment, that is, selection of suitable silencing-acoustic waveform data corresponding to the noise characteristics, may be added to the silencer unit 230 of the third embodiment. In such a case, combination of feed-forward control with feed-back control remarkably improves the noise reduction effects.

The silencer unit 230 may further include a low-pass filter arranged prior to the speaker 235 for cutting excessive noise of the silencing acoustic signal and outputting only a frequency component required for the noise reduction.

The silencer unit 230 may also include an abnormality control unit, which detects abnormality in the silencer unit 230 and cuts an output circuit off when an output current or voltage to the speaker 235 becomes equal to or greater than a predetermined level. This prevents an abnormal compensating sound from being generated.

In the above embodiments, noise reduction at the exhaust side of the pulse combustor is explained in detail. Output of a compensating sound to a supply path, however, reduces a noise at an intake side in the same manner as above. For example, a speaker for outputting a compensating sound may be disposed between the fan 5 and the air chamber 6 to compensate a noise transmitted from the air chamber 6.

As described above, the pulse combustor of the invention generates a compensating sound to be composed with a noise, synchronously with a cycle of pulse combustion. This structure does not require a space-occupying large muffler and realizes compact design of the pulse combustor. Removal of the muffler effectively reduces adverse effects of a pressure loss and attains stable and preferable pulse combustion without higher air or fuel gas supply pressure.

There may be many other modifications, alternations, and changes without departing from the scope or spirit of essential characteristics of the invention, and thereby it is clearly understood that the above embodiments are only illustrative and not restrictive in any sense. The scope and spirit of the invention is only limited by the terms of the appended claims.

What is claimed is:

1. A pulse combustor comprising a mixing chamber for receiving and mixing a fuel gas and air and supplying an air/fuel mixture, a combustion chamber connected to said mixing chamber for pulsative combustion of said air/fuel mixture supplied from said mixing chamber, a tail pipe constituted as a conduit of hot combustion byproducts, a gas supply system for supplying said fuel gas to said mixing chamber, an air supply system for supplying said air to said mixing chamber, and an exhaust conduit for discharging hot combustion byproducts, said pulse combustor further comprising synchronous signal generator means for generating a synchronous signal synchronized with a cycle of said pulsative combustion, data memory means for storing silencing-acoustic waveform data, silencing acoustic signal generator means for outputting a silencing acoustic signal corresponding to said silencing-acoustic waveform data stored in said data memory means, synchronously with said synchronous signal output from said synchronous signal generator means, sound generator means for converting said silencing acoustic signal to a compensating sound and outputting said compensating sound to said exhaust conduit of said hot combustion byproducts and to said air supply system sensor means for detecting said cycle of said pulsative combustion, and control circuit means allowing said sound generator means to output said compensating sound only when said sensor means detects actual combustion conditions.

2. A pulse combustor in accordance with claim 1, wherein said compensating sound has a sound pressure identical with that of a noise due to said pulsative combustion but having its phase shifted by pi radians to be in antiphase to the phase of the noise.

3. A pulse combustor in accordance with claim 1, wherein said sensor means is a pressure sensor disposed in said air supply system.

4. A pulse combustor in accordance with claim 1, wherein said sensor means is a pressure sensor disposed in said combustion chamber.

5. A pulse combustor in accordance with claim 1, said pulse combustor further comprising first regulator means for regulating a sound pressure of said compensating sound generated by said sound generator means, second regulating means for regulating a phase of said compensating sound, sound pressure detecting means for detecting a sound pressure of a composite sound of a noise due to said pulsative combustion with said compensating sound generated by said sound generator means, and feedback control means for monitoring said sound pressure detected by said sound pressure detecting means and actuating said first regulator means and said second regulator means to make said sound pressure minimum.

6. A pulse combustor in accordance with claim 5, said pulse combustor further comprising sound collecting means for detecting said composite sound of said noise with said compensating sound.

7. A pulse combustor in accordance with claim 1, said pulse combustor further comprising a low-pass filter.

8. A pulse combustor in accordance with claim 1, said pulse combustor further comprising abnormality control means for detecting an abnormality and inactivating said sound generator means when said silencing acoustic signal output to said sound generator means has of not less than a predetermined level corresponding to an abnormal compensating sound.

9. A pulse combustor comprising a mixing chamber for receiving and mixing a fuel gas and air supplying an air/fuel mixture, a combustion chamber connected to said mixing chamber for pulsative combustion of said air/fuel mixture supplied from said mixing chamber, a tail pipe constituted as a conduit of hot combustion byproducts, a gas supply system for supplying said fuel gas to said mixing chamber, an air supply system for supplying said air to said mixing chamber, and an exhaust conduit for discharging hot combustion byproducts, said pulse combustor further comprising synchronous signal generator means synchronized with a cycle of said pulsative combustion, noise characteristics detection means for detecting characteristics of a noise due to said pulsative combustion, data memory means for storing a plurality of silencing-acoustic waveform data corresponding to a plurality of noise characteristics, silencing acoustic signal generator means for selecting suitable silencing acoustic waveform data corresponding to said noise characteristics detected by said noise characteristics detection means out of said plurality of silencing-acoustic waveform data, and outputting a silencing acoustic signal corresponding to said selected silencing-acoustic waveform data, synchronously with said synchronous signal output from said synchronous signal generator means, and sound generator means for converting said silencing acoustic signal to a compensating sound and outputting said compensating sound to said exhaust conduit of said hot combustion byproducts and to said air supply system.

10. A pulse combustor in accordance with claim 9, wherein said compensating sound has a sound pressure identical with that of a noise due to said pulsative combustion but having its phase shifted by pi radians to be in antiphase to the phase of the noise.

11. A pulse combustor in accordance with claim 9, wherein said noise characteristics detection means comprises a pulse counter, and said noise characteristics comprise a pulse frequency.

12. A pulse combustor in accordance with claim 9, said pulse combustor further comprising first regulator means for regulating a sound pressure of said compensating sound generated by said sound generator means, second regulating means for regulating a phase of said compensating sound, sound pressure detecting means for detecting a sound pressure of a composite sound of a noise due to said pulsative combustion with said compensating sound generated by said sound generator means, and feedback control means for monitoring said sound pressure detected by said sound pressure detecting means and actuating said first regulator means and said second regulator means to make said sound pressure minimum.

13. A pulse combustor in accordance with claim 12, said pulse combustor further comprising sound collecting means for detecting said composite sound of said noise with said compensating sound.

14. A pulse combustor in accordance with claim 13, said pulse combustor further comprising a low-pass filter.

15. A pulse combustor in accordance with claim 9, said pulse combustor further comprising abnormality control means for detecting an abnormality and inactivating said sound generator means when said silencing-acoustic signal output to said sound generator means has a value of not less than a predetermined level corresponding to an abnormal compensating sound.

* * * * *